US012152306B2

(12) United States Patent
Vajo et al.

(10) Patent No.: US 12,152,306 B2
(45) Date of Patent: Nov. 26, 2024

(54) TITANIUM-BASED COATINGS AND METHODS FOR MAKING COATINGS

(71) Applicant: THE BOEING COMPANY, Chicago, IL (US)

(72) Inventors: John J. Vajo, West Hills, CA (US); Alain A. Adjorlolo, Shoreline, WA (US); Jason A. Graetz, Malibu, CA (US)

(73) Assignee: THE BOEING COMPANY, Arlington, VA (US)

( * ) Notice: Subject to any disclaimer, the term of this patent is extended or adjusted under 35 U.S.C. 154(b) by 749 days.

(21) Appl. No.: 16/239,312

(22) Filed: Jan. 3, 2019

(65) Prior Publication Data

US 2020/0216963 A1 Jul. 9, 2020

(51) Int. Cl.
*C23C 22/34* (2006.01)

(52) U.S. Cl.
CPC ..... *C23C 22/34* (2013.01)

(58) Field of Classification Search
CPC ..... C23C 22/34; C23C 22/05; C09D 1/00; C09D 5/08
See application file for complete search history.

(56) References Cited

U.S. PATENT DOCUMENTS 4,444,601 A 4/1984 Greene
6,440,580 B1 * 8/2002 Berger ..... C08G 59/50 428/629
2005/0067056 A1 3/2005 Shoji et al.
2018/0346673 A1 * 12/2018 Goh ..... B05D 5/00
2019/0048223 A1 * 2/2019 Dustin ..... C08G 18/4854
2020/0131645 A1 * 4/2020 Suto ..... B01J 21/063

FOREIGN PATENT DOCUMENTS

CN 1205000 A 1/1999
CN 101421360 A 4/2009
CN 101439873 A 5/2009
CN 103103512 A 5/2013
CN 105803442 A 7/2016
(Continued)

OTHER PUBLICATIONS

Shigehito et al. "Titanium (IV) Oxide Thin Films Prepared from Aqueous Solution". Chemistry Letters, pp. 433-434 (1996) (Year: 1996).*
Deki, et al., "Titanium (IV) oxide thin films prepared from aqueous solution" Chemistry Letters, 443 (1996).
European Patent Office for Application No. 19218313.5-1103 dated May 13, 2020.
(Continued)

*Primary Examiner* — Alexander M Weddle
(74) *Attorney, Agent, or Firm* — Patterson + Sheridan, LLP

(57) ABSTRACT

Aspects of the present disclosure provide titanium-based coatings and methods for making titanium-based coatings on surfaces. In at least one aspect, a coating includes an oxygen content, a fluorine content, a titanium content, and a sodium content. In one or more additional aspects, a coating includes titanium dioxide and $Na_5Ti_3F_{14}$. In one or more additional aspects, a method of making a titanium-based coating includes contacting a substrate with a composition that includes from about 0.01 M to about 0.8 M of a titanium fluoride, from about 0.01 M to about 2 M of a sodium salt, and from about 0.1 M to about 1.5 M of a fluorine scavenger.

20 Claims, 8 Drawing Sheets

(56) References Cited

FOREIGN PATENT DOCUMENTS

| | | | | |
|---|---|---|---|---|
| CN | 106958014 | A | 7/2017 | |
| CN | 106987832 | A | 7/2017 | |
| CN | 111032802 | A | 4/2020 | |
| JP | S56-044775 | A | 4/1981 | |
| JP | 2005-264230 | A | 9/2005 | |
| JP | 2006181911 | A | 7/2006 | |
| JP | 2014-101585 | A | 6/2014 | |
| JP | 2014-156615 | A | 8/2014 | |
| JP | 2014-208874 | A | 11/2014 | |
| JP | 2018-500258 | A | 1/2018 | |
| WO | 02061005 | A1 | 8/2002 | |
| WO | WO-2018225861 | A1 * | 12/2018 | ..... A61L 2/088 |

OTHER PUBLICATIONS

European Patent Office, Communication Pursuant to Article 94(3) EPC for Application 19 218 313.5-1103 dated Dec. 13, 2021.
Office Action for Indian Patent Application No. 2020140002301, dated Jan. 2, 2023.
China National Intellectual Property Administration, First Notification of Office Action for Application 202010000858.3 dated Jul. 22, 2023.
Japanese Office Action dated Oct. 2, 2023 for Application No. 2019-226593.
Japanese Office Action dated Mar. 18, 2024 for Application No. 2019-226593.
Japanese Office Action dated Sep. 2, 2024 for Application No. 2019-226593.

* cited by examiner

TITANIUM-BASED COATINGS AND METHODS FOR MAKING COATINGS

FIELD

Aspects of the present disclosure provide titanium-based coatings and methods for making titanium-based coatings on surfaces.

BACKGROUND

Aircraft surfaces are typically made of a metal, such as aluminum, steel or titanium. Corrosion protection of aircraft metallic surfaces has typically relied on primers having hexavalent chromium. However, there is regulatory pressure to eliminate the use of hexavalent chromium from primers and pretreatments.

Therefore, there is a continuing need for new and improved corrosion resistant coatings and methods of forming corrosion resistant coatings.

SUMMARY

Aspects of the present disclosure provide titanium-based coatings and methods for depositing titanium-based coatings onto aluminum surfaces.

In at least one aspect, a coating includes an oxygen content, a fluorine content, a titanium content, and a sodium content.

In one or more additional aspects, a coating includes titanium dioxide and $Na_5Ti_3F_{14}$.

In one or more additional aspects, a method of making a titanium-based coating includes contacting a substrate with an aqueous solution composition that includes from about 0.01 M to about 0.8 M of a titanium fluoride, from about 0.01 M to about 2 M of a sodium salt, and from about 0.1 M to about 1.5 M of a fluorine scavenger.

BRIEF DESCRIPTION OF THE DRAWINGS

So that the manner in which the above recited features of the present disclosure can be understood in detail, a more particular description of the disclosure, briefly summarized above, may be had by reference to aspects, some of which are illustrated in the appended drawings. It is to be noted, however, that the appended drawings illustrate only typical aspects of this present disclosure and are therefore not to be considered limiting of its scope, for the present disclosure may admit to other equally effective aspects.

To facilitate understanding, identical reference numerals have been used, where possible, to designate identical elements that are common to the figures. It is contemplated that elements and features of one aspect may be beneficially incorporated in other aspects without further recitation.

DETAILED DESCRIPTION

Figure 1:
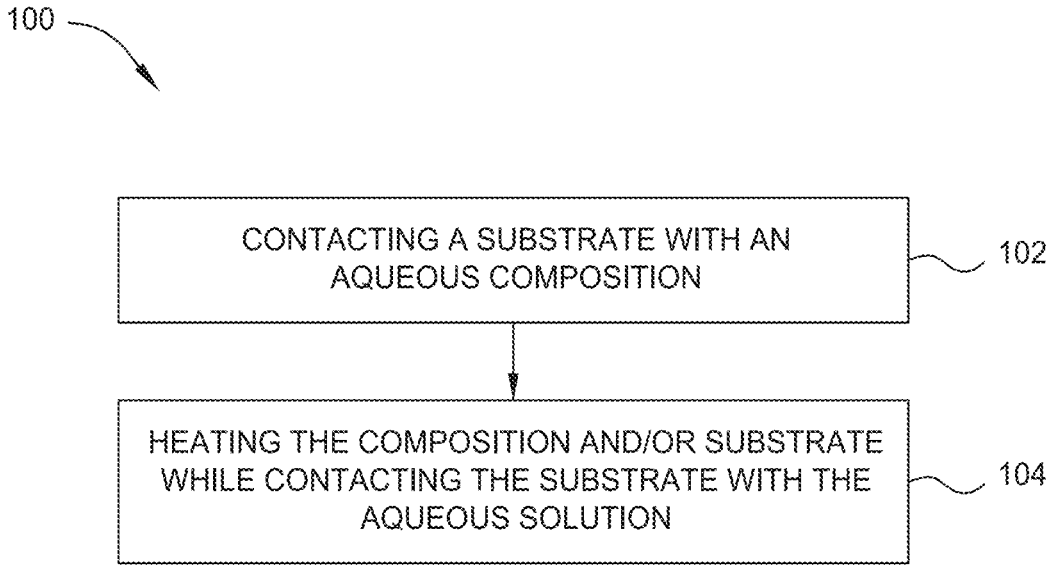
FIG. 1 is a flow diagram of a method for forming a titanium-based coating, according to one aspect.

Aspects of the present disclosure provide titanium-based coatings and methods for making titanium-based coatings on surfaces. In at least one aspect, a coating includes an oxygen content, a fluorine content, a titanium content, and a sodium content. In one or more additional aspects, a coating includes titanium dioxide and $Na_5Ti_3F_{14}$. In one or more additional aspects, a method of making a titanium-based coating includes contacting a substrate with a composition that includes from about 0.01 M to about 0.8 M of a titanium fluoride, from about 0.01 M to about 2 M of a sodium salt, and from about 0.1 M to about 1.5 M of a fluorine scavenger.

It has been discovered that including a sodium salt in the composition can provide a sodium content to the titanium-based coating (e.g. can provide $Na_5Ti_3F_{14}$, such as crystalline $Na_5Ti_3F_{14}$). Without being bound by theory, it is believed that the halide content of the salt additive can etch a native surface oxide on the substrate which provides deposition of a more adherent coating, as compared to conventional titanium-based coatings. In addition, halides are typically regarded as promoting corrosion of metal substrates, such as aluminum substrates. However, it has been discovered that titanium-based coatings of the present disclosure formed from halide-containing salts, and the coatings including sodium content (e.g. $Na_5Ti_3F_{14}$, such as crystalline $Na_5Ti_3F_{14}$), can provide improved corrosion resistance as compared to a titanium-based coating without a sodium content.

Titanium-Based Coatings

Titanium-based coatings of the present disclosure include an oxygen content, a fluorine content, a titanium content, and a sodium content.

In at least one aspect, a titanium-based coating has a substantially uniform thickness. Different thicknesses of the titanium-based coating may be obtained by controlling contact time of the substrate with the aqueous solution composition, as described in more detail below. Generally, a longer contact time results in a thicker coating.

For example, thickness of the titanium-based coating may be from about 0.01 mil to about 0.5 mil, such as from about 0.02 mil to about 0.2 mil, such as from about 0.05 mil to about 1.5 mil, such as about 1 mil. Thick coatings can increase corrosion resistance as compared to a thinner coating. However, too thick of a coating may crack and/or flake off.

In one or more aspects, a titanium-based coating of the present disclosure contains an amorphous metal oxide phase and a crystalline sodium-containing phase. The term "amorphous" as used herein refers to a solid material that does not exhibit long-range crystalline order and/or has no substantial crystal lattice structure, as determined by X-ray diffraction. The term "crystalline" as used herein refers to a solid material that exhibits long-range crystalline order and/or has substantial crystal lattice structure, as determined by X-ray diffraction. Without being bound by theory, an amorphous phase does not have crystal grain boundaries, and the reduction in the number of crystal grain boundaries provides improved structural integrity of the coating, as compared to a crystalline coating.

Crystallinity can be determined by the width of a diffraction peak. For example, for a crystalline substance, the width is about 1 degree or less. If the width is greater than 2 degrees or up to 10 degrees, then it is amorphous.

Metal of the metal oxide may be titanium (Ti). Accordingly, the titanium-based coating may include an amorphous titanium oxide phase and a crystalline titanium fluoride phase.

A titanium-based coating of the present disclosure can have a fluorine content. For example, a titanium-based coating may have a fluorine content of from about 1 atomic percent (at. %) to about 80 at. %, such as about 10 at. % to about 70 at. %, about 15 at. % to about 50 at. %, about 20 at. % to about 50 at. %, about 25 at. % to about 50 at. %, about 30 at. % to about 45 at. %, about 35 at. % to about 45 at. %, or about 38 at. % to about 42 at. %, for example about 40 at. %, as determined by X-ray spectroscopy (EDX).

A titanium-based coating of the present disclosure can have an oxygen content. For example, a titanium-based coating may have an oxygen content of from about 1 atomic percent (at. %) to about 80 at. %, such as about 5 at. % to about 60 at. %, about 5 at. % to about 50 at. %, about 10 at. % to about 50 at. %, about 15 at. % to about 45 at. %, about 18 at. % to about 35 at. %, about 20 at. % to about 30 at. %, or about 22 at. % to about 28 at. %, for example about 25 at. %, as determined by EDX.

A titanium-based coating of the present disclosure can have a titanium content. For example, a titanium-based coating may have a titanium content of from about 1 atomic percent (at. %) to about 60 at. %, such as about 2 at. % to about 40 at. %, about 3 at. % to about 30 at. %, about 4 at. % to about 25 at. %, about 5 at. % to about 20 at. %, about 10 at. % to about 20 at. %, about 12 at. % to about 20 at. %, or about 14 at. % to about 18 at. %, for example about 16 at. %, as determined by EDX.

A titanium-based coating of the present disclosure can have a sodium content. For example, a titanium-based coating may have a sodium content of from about 1 atomic percent (at. %) to about 60 at. %, such as about 2 at. % to about 40 at. %, about 3 at. % to about 30 at. %, about 4 at. % to about 25 at. %, about 5 at. % to about 20 at. %, about 10 at. % to about 20 at. %, about 12 at. % to about 20 at. %, or about 16 at. % to about 20 at. %, for example about 18 at. %, as determined by EDX.

A titanium-based coating of the present disclosure can have a titanium dioxide content. For example, a titanium-based coating may have a titanium dioxide content of from about 1 weight percent (wt %) to about 99 wt %, such as about 5 wt % to about 95 wt %, about 5 wt % to about 70 wt %, about 30 wt % to about 70 wt %, about 35 wt % to about 60 wt %, about 40 wt % to about 55 wt %, for example about 45 wt %, based on the total weight of the coating, as determined by EDX. Alternatively, a titanium-based coating can have a titanium dioxide content of from about 1 wt % to about 20 wt %, about 1 wt % to about 10 wt %, for example about 8 wt %. Alternatively, a titanium-based coating can have a titanium dioxide content of from about 75 wt % to about 99 wt %, about 80 wt % to about 95 wt %, about 80 wt % to about 90 wt %, for example about 85 wt %. The titanium dioxide may be present as an amorphous phase or a crystalline phase, such as an amorphous phase.

A titanium-based coating of the present disclosure can have a $Na_5Ti_3F_{14}$ content. For example, a titanium-based coating may have a $Na_5Ti_3F_{14}$ content of from about 1 weight percent (wt %) to about 99 wt %, such as about 5 wt % to about 95 wt %, about 5 wt % to about 70 wt %, about 30 wt % to about 70 wt %, about 35 wt % to about 60 wt %, about 40 wt % to about 55 wt %, for example about 45 wt %, based on the total weight of the coating, as determined by EDX. Alternatively, a titanium-based coating can have a $Na_5Ti_3F_{14}$ content of from about 1 wt % to about 20 wt %, about 1 wt % to about 10 wt %, for example about 8 wt %. Alternatively, a titanium-based coating can have a $Na_5Ti_3F_{14}$ content of from about 75 wt % to about 99 wt %, about 80 wt % to about 95 wt %, about 80 wt % to about 90 wt %, for example about 85 wt %. The $Na_5Ti_3F_{14}$ may be present in the coating as a crystalline phase or an amorphous phase, such as a crystalline phase.

In one aspect, a titanium-based coating of the present disclosure includes from about 40 wt % to about 50 wt % amorphous titanium dioxide and from about 50 wt % to about 60 wt % crystalline $Na_5Ti_3F_{14}$.

Methods of Making Titanium-Based Coatings

The present disclosure further provides methods for making titanium-based coatings on surfaces.

Methods include providing an aqueous solution composition (which is a composition formed in water) comprising a titanium fluoride. The titanium fluoride may be $TiF_4$, $TiF_2$ or a metal fluorine complex having general formula $A_2TiF_6$, where A is selected from hydrogen, alkali metal, an ammonium group, coordinated water, or a combination thereof. For example, the titanium fluoride may be hexafluorotitanic acid, sodium hexafluorotitanate, potassium hexafluorotitanate, or ammonium hexafluorotitanate. For example, the titanium fluoride is ammonium hexafluorotitanate ($(NH_4)_2TiF_6$). A titanium fluoride provides a source of titanium and a source of fluorine to the coating.

Concentration of titanium fluoride in the aqueous solution composition may be from about 0.01 M to about 0.8 M. For example, concentration of titanium fluoride in the aqueous solution composition may be from about 0.1 M to about 0.4 M, about 0.1 M to about 0.35 M, about 0.15 M to about 0.35 M, about 0.15 M to about 0.3 M, about 0.18 M to about 0.3 M, about 0.18 M to about 0.25 M, about 0.18 M to about 0.22 M, for example about 0.2 M. The concentration of titanium fluoride can provide control of the thickness of the coating that is formed, the rate of coating deposition, the morphology of the coating, and or the corrosion protection qualities of the coating.

The aqueous solution composition further includes a sodium salt. A sodium salt may be sodium chloride, sodium fluoride, sodium bromide, or sodium iodide, for example a sodium salt is sodium chloride. A sodium salt provides a source of sodium to the formed coating. It has been discovered that including a sodium salt in the composition can provide a sodium content to the titanium-based coating (e.g. can provide $Na_5Ti_3F_{14}$, such as crystalline $Na_5Ti_3F_{14}$). The halide content can etch a native surface oxide on the substrate which provides deposition of a more adherent coating, as compared to conventional titanium-based coatings. In addition, halides are typically regarded as promoting corrosion of metal substrates, such as aluminum substrates. However, it has been discovered that titanium-based coatings of the present disclosure formed from halide-containing salts (the sodium salts of the present disclosure), and the coatings including a sodium content (e.g. $Na_5Ti_3F_{14}$, such as crystalline $Na_5Ti_3F_{14}$), can provide improved corrosion resistance as compared to a titanium-based coating without a sodium content.

The concentration of sodium salt in the aqueous solution composition may be from about 0.01 M to about 2 M. For example, concentration of sodium salt in the aqueous solution composition may be from about 0.1 M to about 1.8 M, about 0.1 M to about 1.7 M, about 0.1 M to about 1.2 M, alternatively about 0.2 M to about 1.6 M, about 0.3 M to about 1.5 M, about 0.4 M to about 1.4 M, about 0.75 M to about 1.4 M, about 0.9 M to about 1.4 M, about 1 M to about 1.3 M, for example about 1.2 M. Alternatively, concentration of sodium salt in the aqueous solution composition is from about 0.1 M to about 0.6 M, about 0.2 M to about 0.5M, about 0.25 M to about 0.35 M, for example about 0.3 M. The concentration of sodium salt can provide control of the thickness of the coating that is formed, the rate of coating deposition, the morphology of the coating, and or the corrosion protection qualities of the coating.

The aqueous solution composition may further comprise a fluorine scavenger. As used herein, the term "fluorine scavenger" refers to a compound or element that is capable of capturing fluoride ions in the aqueous solution composition comprising the titanium fluoride to precipitate the titanium-based coating. By providing an aqueous solution composition comprising a titanium fluoride, sodium salt, and a fluorine scavenger, and contacting a substrate with the aqueous solution composition, a titanium-based coating may be precipitated or deposited on the substrate.

The fluorine scavenger may be selected from boric acid, alkali metal borate, ammonium borate, boron anhydride, boron monoxide, aluminum chloride, metallic aluminum, aluminum oxide, or a combination thereof. In various aspects, the fluorine scavenger is boric acid.

The concentration of fluorine scavenger in the aqueous solution composition may be from about 0.1 M to about 1.5 M. For example, concentration of fluorine scavenger in the aqueous solution composition may be from about 0.3 M to about 1 M, about 0.35 M to about 1 M, about 0.35 M to about 0.9 M, about 0.35 M to about 0.85 M, about 0.4 M to about 0.85 M, about 0.4 M to about 0.8 M, about 0.4 M to about 0.75 M, about 0.45 M to about 0.75 M, about 0.5 M to about 0.75 M, about 0.55 M to about 0.7 M, such as about 0.6 M or about 0.65 M. The concentration of fluorine scavenger can provide control of the thickness of the coating that is formed, the rate of coating deposition, the morphology of the coating, and or the corrosion protection qualities of the coating.

FIG. 1 is a flow diagram of a method 100 for forming a titanium-based coating. A titanium-based coating can be formed by contacting 102 a substrate with the aqueous solution composition, e.g. at a temperature of less than about 100° C., to obtain the titanium-based coating on the substrate. For example, a substrate can be introduced facedown into the solution at room temperature for a period of time.

Shape and structure of the substrate may be arbitrarily selected, and is not limited to a planar surface. For example, the substrate may have a non-planar shape, and having a surface onto which the amorphous titanium-based coating is to be applied. The substrate may be of any suitable material, such as glass, metals, ceramics, organic polymer materials, plastics, or semiconductors. For example, a substrate can be a metal substrate made of aluminum, aluminum alloy, nickel, iron, iron alloy, steel, titanium, titanium alloy, copper, copper alloy, or a mixture thereof.

A substrate can be a component, such as a blade of a wind turbine. In at least one aspect, a substrate is a vehicle component. A vehicle component is any suitable component of a vehicle, such as a structural component, such as a panel or joint, of an aircraft, automobile, etc. Examples of a vehicle component include an airfoil (such as a rotor blade), an auxiliary power unit, a nose of an aircraft, a fuel tank, a tail cone, a panel, a coated lap joint between two or more panels, a wing-to-fuselage assembly, a structural aircraft composite, a fuselage body-joint, a wing rib-to-skin joint, and/or other internal component.

Contacting a substrate with the aqueous solution composition may be carried out by immersing the substrate in the aqueous solution composition. The titanium-based coating may be precipitated on at least a portion of the substrate that is in contact with the aqueous solution composition. In various embodiments, the titanium-based coating is precipitated on substantially all of the substrate that is in contact with the aqueous solution composition.

Rate of formation of metal oxide may be controlled by concentration of and ratio of titanium fluoride to fluorine scavenger, titanium fluoride to sodium salt, sodium salt to fluorine scavenger, pH, and temperature, for example.

For example, referring to the equations shown below, by Le Chatelier's principle, a higher concentration of titanium fluoride on the left side of the equation results in a faster forward reaction, as this drives the equation to the right. By the same principle, lowering concentration of HF present on the right side of the equation, for example, by increasing concentration of fluorine scavenger such as $H_3BO_3$, drives the equation to the right, resulting in faster formation of metal oxide.

$$[TiF_6]^{2-}+nH_2O \rightarrow [TiF_{6-n}(OH)_n]^{2-}+nHF$$

$$H_3BO_3+4HF \rightarrow HBF_4+3H_2O$$

pH, on the other hand, may affect solubility of the target metal oxide. Generally, the lower the solubility of the target metal oxide, the higher the driving force for precipitation.

Contacting 102 may be performed at ambient temperature (e.g. room temperature such as about 23° C.). Alternatively, Method 100 includes optionally heating 104 the composition and/or the substrate while contacting the substrate with the aqueous solution composition.

In various embodiments, heating the substrate and/or the composition is performed at a temperature of from about 40° C. to about 80° C., such as about 45° C. to about 70° C., about 50° C. to about 65° C., about 55° C. to about 65° C., about 60° C. In some embodiments, contacting a substrate with the aqueous solution composition is carried out at a temperature of about 60° C. to obtain a titanium-based coating on the substrate.

Contacting 102 a substrate with the aqueous solution composition may be carried out for any suitable time period that is sufficient to obtain the titanium-based coating. The time period may depend on the titanium fluoride used, as well as temperature at which the substrate is contacted with the aqueous solution composition. If lower temperatures are used, for example, a longer contacting time to deposit or to form the titanium-based coating may be suitable. By controlling the contacting time, thickness of titanium-based coating that is formed on the substrate may be controlled.

In various aspects, contacting a substrate with the aqueous solution composition is carried out for a time period of from about 2 hours to about 24 hours, such as about 4 hours to about 24 hours, about 6 hours to about 24 hours, about 12 hours to about 24 hours, for example about 16 hours.

Aspects

Overall the effect of one or more (e.g., all) of these variables is to influence the properties of the coatings. The properties influenced may be one or more of: 1) physical properties such as thickness and morphology (smooth, rough, cracked, uniform, patchy) 2) chemical properties such as elemental and phase composition, and 3) performance properties such as corrosion protection, adhesion to the substrate (which affects the corrosion protection, and adhesion to additional coating layers (such as primers and clear coats) place on top of the coating.

Clause 1. A coating disposed on a surface, the coating comprising:
an oxygen content;
a fluorine content;
a titanium content; and
a sodium content.

Clause 2. The coating of Clause 1, wherein the coating has a thickness of from about 0.01 mil to about 0.5 mil.

Clause 3. The coating of Clauses 2 or 3, wherein the coating has a thickness of from about 0.02 mil to about 0.2 mil.

Clause 4. The coating of any of Clauses 1 to 3, wherein the coating comprises an amorphous metal oxide phase and a crystalline sodium-containing phase.

Clause 5. The coating of any of Clauses 1 to 4, wherein the coating comprises a fluorine content of from about 25 at. % to about 50 at. %.

Clause 6. The coating of any of Clauses 1 to 5, wherein the coating comprises a sodium content of from about 4 at. % to about 25 at. %.

Clause 7. The coating of any of Clauses 1 to 6, wherein the coating comprises a sodium content of from about 16 at. % to about 20 at. %.

Clause 8. The coating of any of Clauses 1 to 7, wherein the coating comprises an oxygen content of from about 20 at. % to about 30 at. %.

Clause 9. The coating of Clause 8, wherein the coating comprises a titanium content of from about 10 at. % to about 20 at. %.

Clause 10. A vehicle component comprising the coating of any of Clauses 1 to 9, wherein the surface is a surface of the vehicle component.

Clause 11. A coating disposed on a surface, the coating comprising titanium dioxide and $Na_5Ti_3F_{14}$.

Clause 12. The coating of Clause 11, wherein the coating has a titanium dioxide content of from about 30 wt % to about 70 wt %, based on the total weight of the coating.

Clause 13. The coating of Clauses 11 or 12, wherein the coating has a $Na_5Ti_3F_{14}$ content of from about 30 wt % to about 70 wt %, based on the total weight of the coating.

Clause 14. The coating of any of Clauses 11 to 13, wherein the coating has a thickness of from about 10 mil to about 50 mil.

Clause 15. The coating of any of Clauses 11 to 14, wherein the coating has a thickness of from about 20 mil to about 40 mil.

Clause 16. The coating of any of Clauses 11 to 15, wherein the coating comprises an amorphous metal oxide phase and a crystalline sodium-containing phase.

Clause 17. The coating of any of Clauses 11 to 16, wherein the coating comprises from about 40 wt % to about 50 wt % amorphous titanium dioxide and from about 50 wt % to about 60 wt % crystalline $Na_5Ti_3F_{14}$, based on the total weight of the coating.

Clause 18. A vehicle component comprising the coating of any of Clauses 11 to 17, wherein the surface is a surface of the vehicle component.

Clause 19. A method of making a titanium-based coating, the method comprising:
contacting a substrate with a composition comprising:
from about 0.01 M to about 0.8 M of a titanium fluoride;
from about 0.01 M to about 2 M of a sodium salt; and
from about 0.1 M to about 1.5 M of a fluorine scavenger.

Clause 20. The method of Clause 19, wherein the composition comprises:
from about 0.1 M to about 0.4 M of the titanium fluoride;
from about 0.1 M to about 1.8 M of the sodium salt; and
from about 0.3 M to about 1 M of the fluorine scavenger.

Clause 21. The method of Clauses 19 or 20, wherein the sodium salt is sodium chloride.

Clause 22. The method of any of clauses 19 to 21, wherein the titanium fluoride is $(NH_4)_2TiF_6$.

Clause 23. The method of any of clauses 19 to 22, wherein the fluorine scavenger is boric acid.

Clause 24. The method of any of clauses 19 to 23, wherein the substrate comprises aluminum.

Clause 25. The method of any of clauses 19 to 24, wherein the substrate is a vehicle component of an aircraft.

Clause 26. The method of any of clauses 19 to 25, wherein contacting comprises immersing the substrate in the aqueous solution composition.

Clause 27. The method of any of clauses 19 to 26, further comprising heating the composition to a temperature of from about 40° C. to about 80° C.

Clause 28. The method of any of clauses 19 to 27, further comprising heating the substrate to a temperature of from about 40° C. to about 80° C.

EXAMPLES all chemicals were obtained from Aldrich and used as received (no purification).

Methods: Corrosion of a panel coated with a titanium-based coating (a sample) can be monitored using electrochemical methods. Electrochemical impedance spectroscopy (EIS) was performed on coated and uncoated aluminum panels in an aqueous electrolyte containing 0.1 M NaCl. Typical measurement were performed with a neutral electrolyte (using a borate buffer to maintain pH 6.4), but measurements in acidic conditions, pH 3.0 (prepared using HCl), and basic conditions, pH 10.0 (prepared using NaOH), were also performed. A Pt wire was used as a counter electrode along with a Ag/AgCl reference electrode. EIS measurements were performed using an AC bias voltage of +−10 mV over a frequency range of $10^{-2}$ to $10^5$ Hz. Corrosion resistance was determined using a circuit model with a single resistor and a constant phase element in parallel.

The coatings were deposited by immersing the surface to be coated facedown in the precursor solution for 16 hours at room temperature. The substrates used were ~1"×1" 2024 Al coupons and 4"×6" 2024 Al panels prepared using a standard surface preparation. Following coating, the coated surface was rinsed (running DI water, ~1 min to 5 min) and dried at room temperature.

Figure 2A:
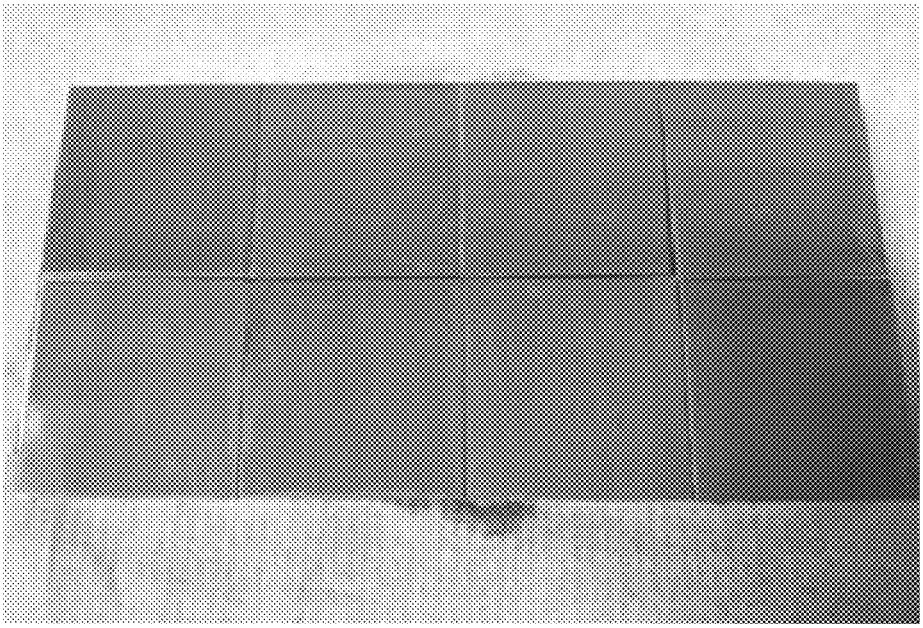
FIG. 2*a* is an optical image showing eight aluminum panels after application of titanium-based coating.
Figure 2B:
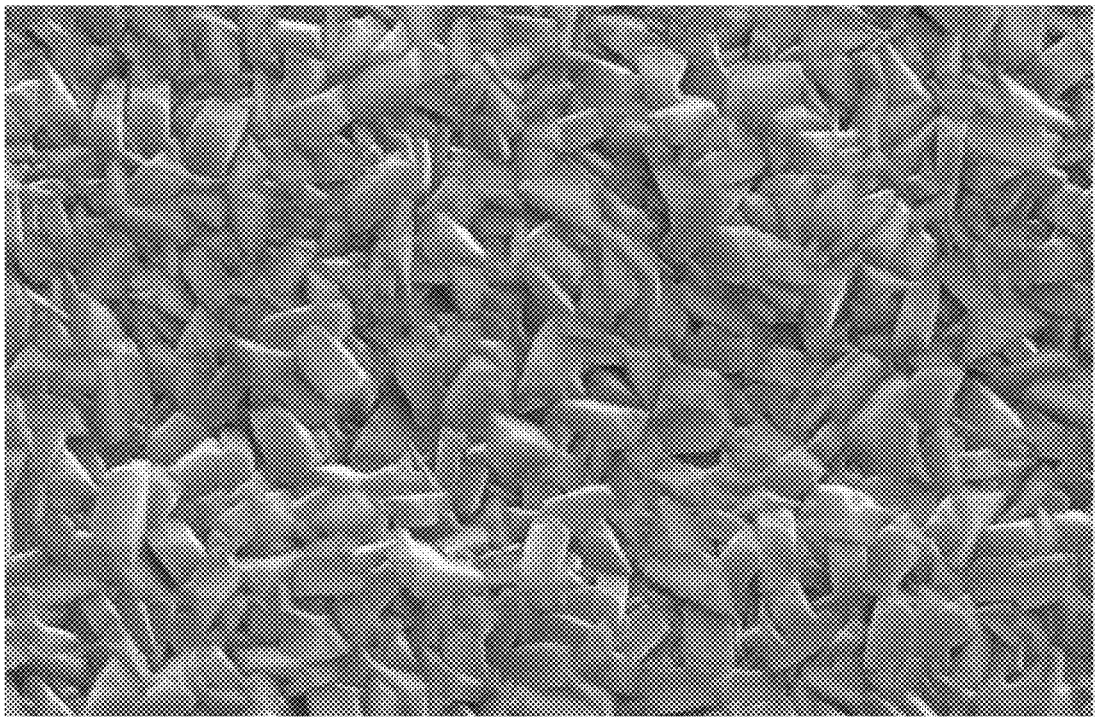
FIG. 2*b* is a scanning electron microscope image of a titanium-based coating, according to one aspect.

The appearance of a coating containing titanium dioxide and $Na_5Ti_3F_{14}$ is shown in FIG. 2*a*. Optically (FIG. 2*a*), the surface appears as a matte brown without any visible signs of corrosion, such as pits or corrosion product deposits. Using scanning electron microscopy (SEM), micrometer size crystallites were apparent (FIG. 2*b*).

Figure 3:
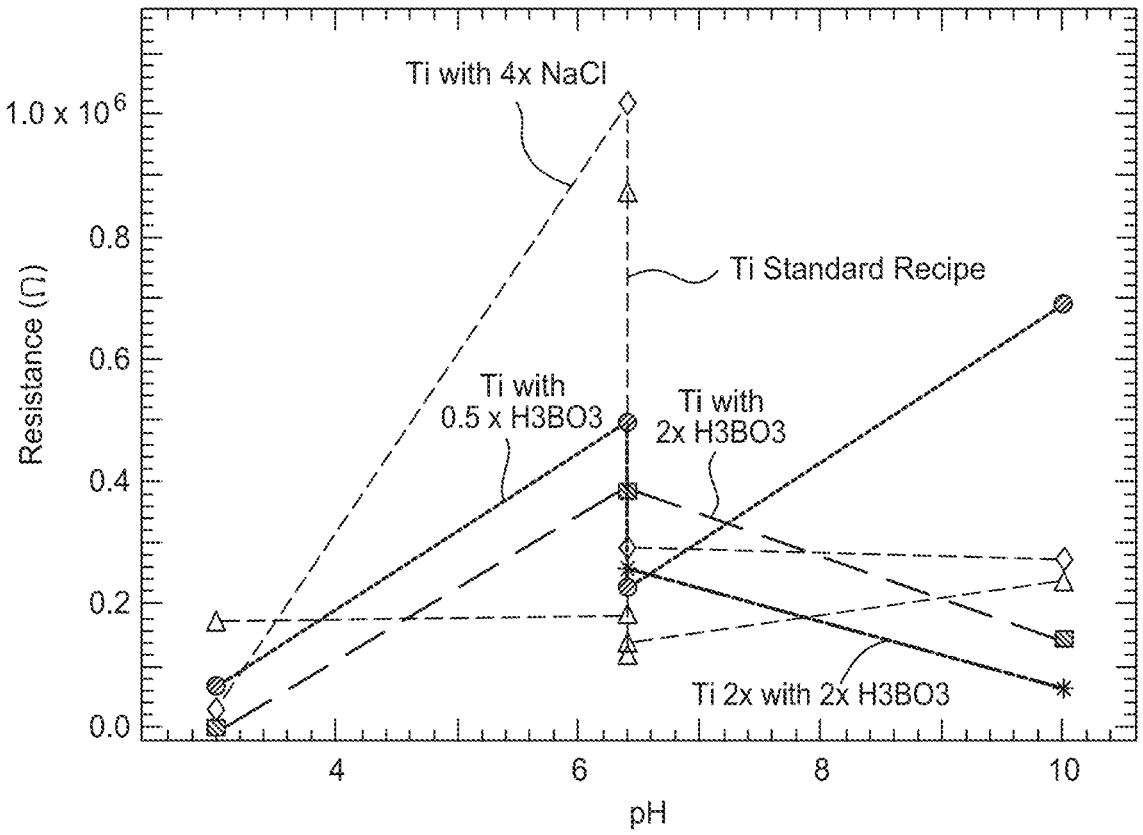
FIG. 3 is a graph illustrating polarization resistance of titanium-based coatings, according to one aspect.
Figure 4A:
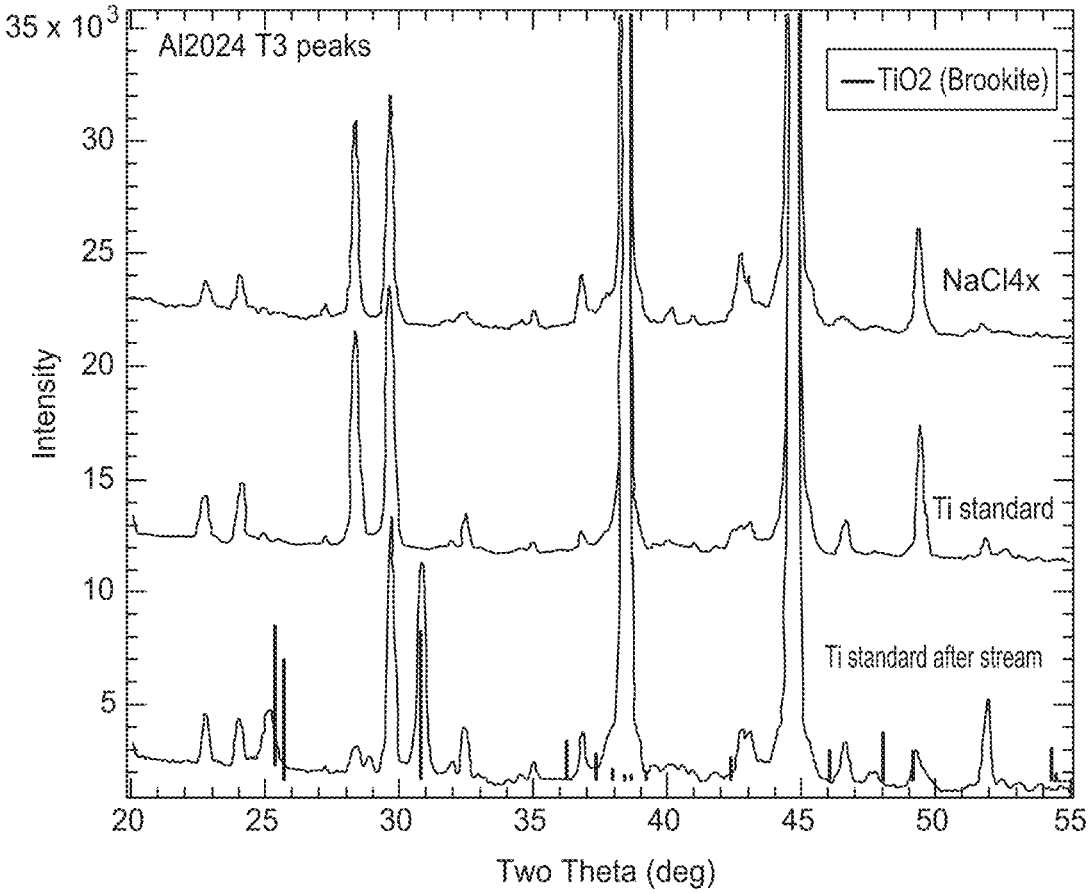
FIG. 4A is a graph illustrating x-ray diffraction spectra of titanium-based coatings, according to one aspect.
Figure 4B:
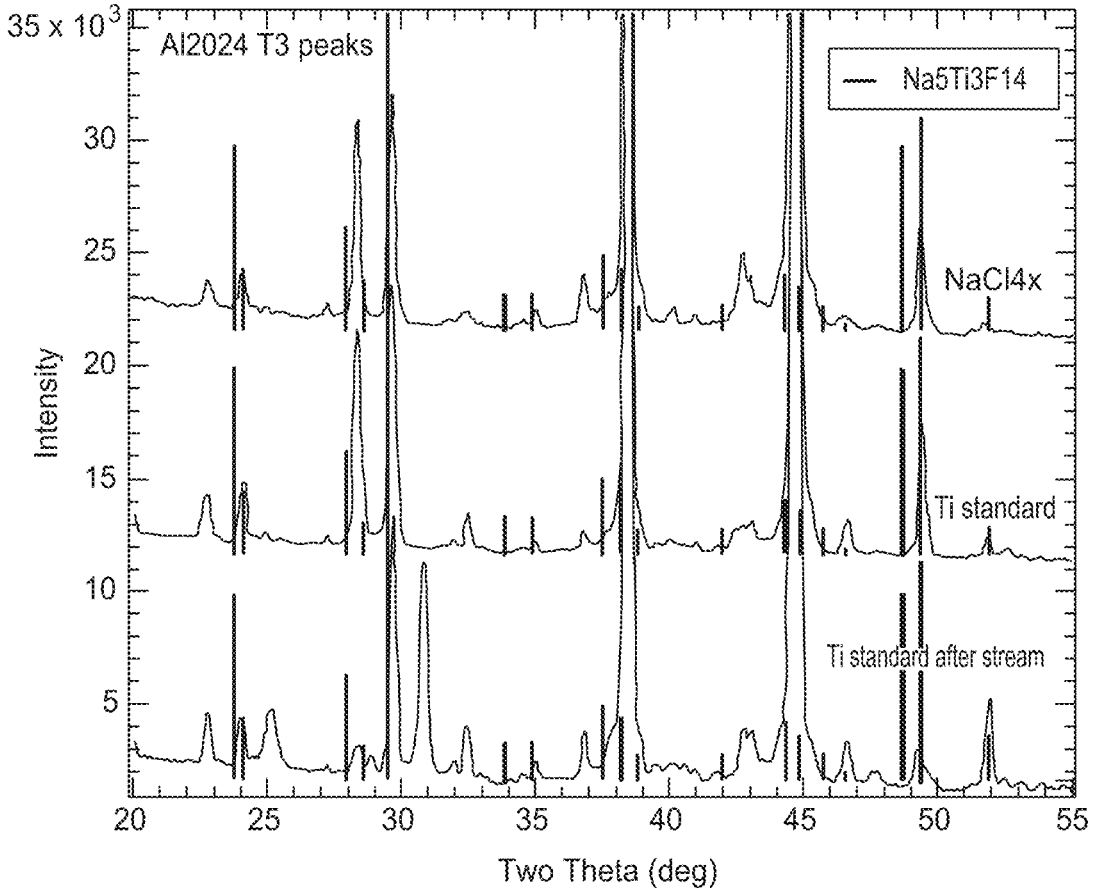
FIG. 4B is a graph illustrating x-ray diffraction spectra of titanium-based coatings, according to one aspect.
Figure 4C:
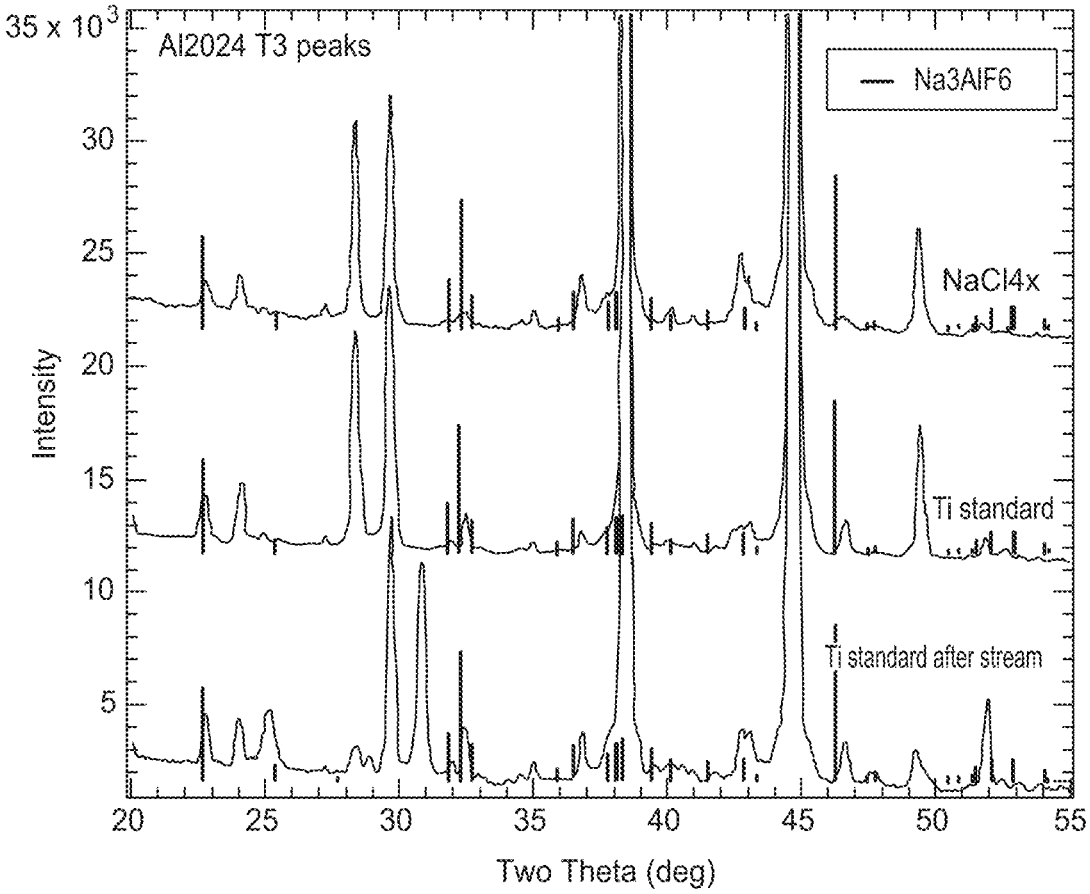
FIG. 4C is a graph illustrating x-ray diffraction spectra of titanium-based coatings, according to one aspect.
Figure 4D:
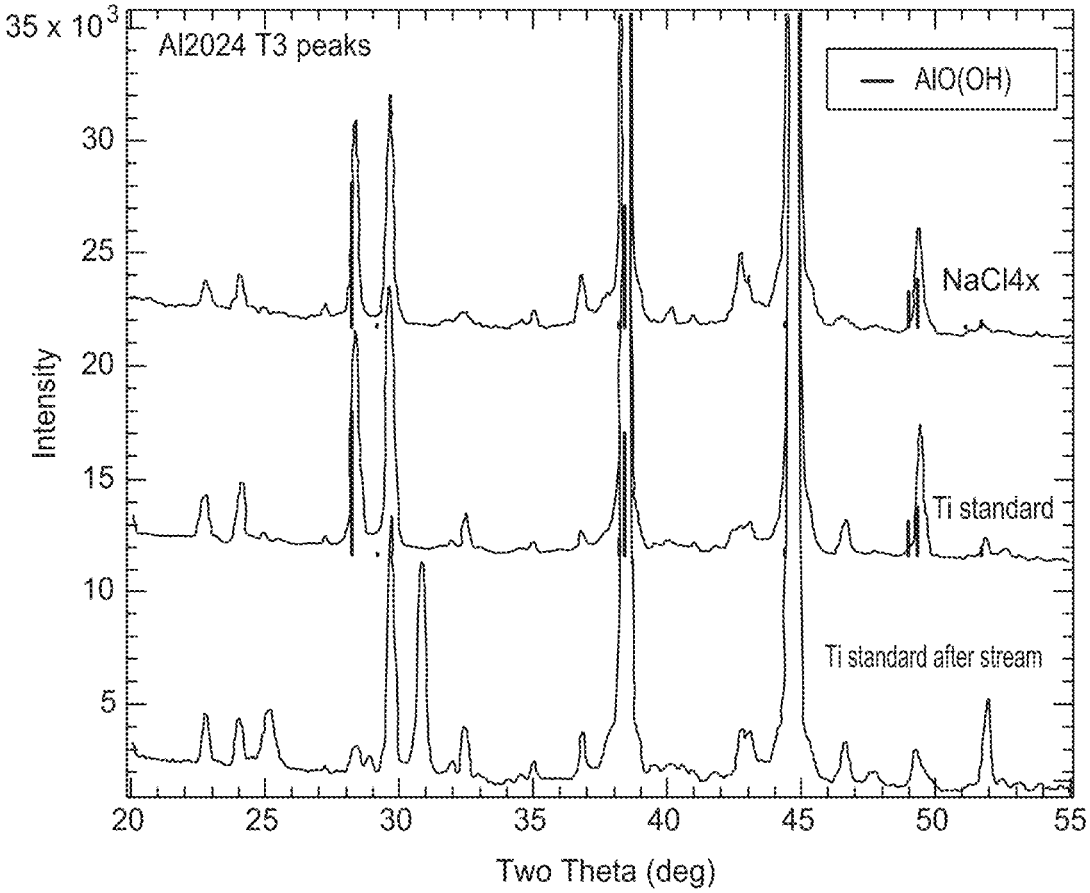
FIG. 4D is a graph illustrating x-ray diffraction spectra of titanium-based coatings, according to one aspect.
Figure 4E:
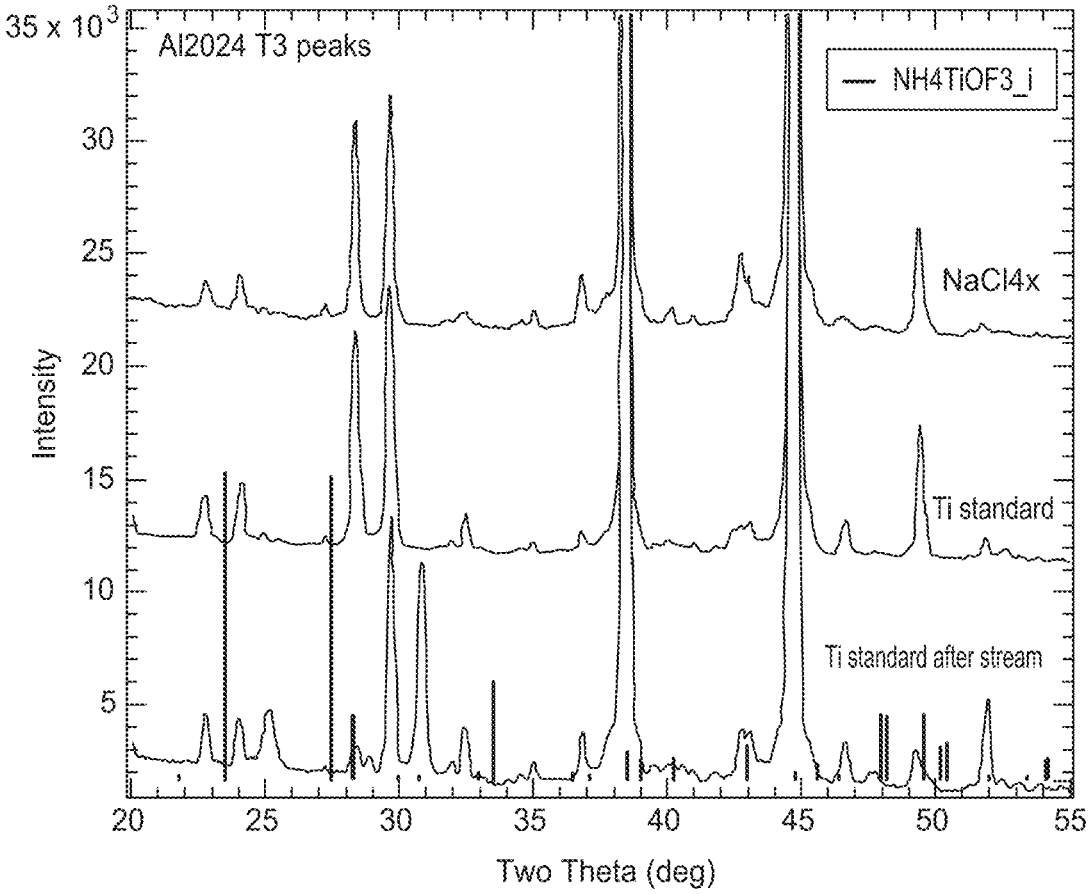
FIG. 4E is a graph illustrating x-ray diffraction spectra of titanium-based coatings, according to one aspect.

Following coating, samples were tested for corrosion protection in a bulk electrolyte of 0.1 M NaCl buffered with borate at pH 6.4, as well as unbuffered at pH 3 and 10. Electrochemical impedance spectroscopy (EIS) was used to determine the polarization resistance. The polarization resistance is a measure of the corrosion protection with higher polarization resistance corresponding to improved corrosion protection. The polarization resistances of several titanium dioxide/$Na_5Ti_3F_{14}$ coatings are shown in FIG. 3. The coatings had a thickness of from about 1 micrometer to about 5 micrometers.

The "Ti standard" recipe corresponds to a 0.2 M $(NH_4)_2TiF_6$, 0.6 M $H_3BO_3$, and 0.3 M NaCl precursor solution. The "Ti with 4× NaCl" recipe corresponds to a 0.2 M $(NH_4)_2TiF_6$, 0.6 M $H_3BO_3$, and 1.2 M NaCl precursor solution. The "Ti with 0.5×$H_3BO_3$" recipe corresponds to a 0.2 M $(NH_4)_2TiF_6$, 0.3 M $H_3BO_3$, and 0.3 M NaCl precursor solution. The "Ti with 2×$H_3BO_3$" recipe corresponds to a 0.2 M $(NH_4)_2TiF_6$, 1.0 M $H_3BO_3$, and 0.3 M NaCl precursor solution. The "Ti 2× with 2×$H_3BO_3$" recipe corresponds to a 0.4 M $(NH_4)_2TiF_6$, 1.0 M $H_3BO_3$, and 0.3 M NaCl precursor solution. At pH 6.4, coatings with polarization resistances of 100 kOhms to 1 MOhm were obtained. This may be compared with an uncoated Al surface which has a resistance of ~10 kOhms. Thus, increases relative to uncoated surfaces of 10× to 100× were seen.

To determine the composition of the coatings, X-ray diffraction (XRD) analysis was performed to identify the crystalline phases, and energy dispersive X-ray spectroscopy (EDX) was performed to determine the elemental composition. As shown in FIG. 4, coated samples show predominately $Na_5Ti_3F_{14}$ (see NaCl 4× and Ti standard recipe patterns). After treatment of a Ti standard recipe coating with steam, peaks corresponding to the Brookite phase of $TiO_2$ are seen. (Steaming was performed by facing the sample down where the sample was held about an inch above the surface of water in a jar in a 110° C. oven overnight.) The results indicate that the coating as deposited from the precursor solution is comprised of crystalline $Na_5Ti_3F_{14}$ together with amorphous $TiO_2$.

FIGS. 4A-4E show XRD patterns of the coatings. (top): Pattern from a "NaCl 4×" recipe, which is 0.2 M $(NH_4)_2TiF_6$+0.6 M $H_3BO_3$+1.2 M NaCl. (middle): Pattern from a "Ti standard" recipe, which is 0.2 M $(NH_4)_2TiF_6$+0.6 M $H_3BO_3$+0.3 M NaCl. (bottom): Pattern from Ti standard recipe after treatment in steam. The minor peaks shown in the XRD spectra are the peaks of the Al 2024 alloy substrate.

To quantify the relative amounts of $Na_5Ti_3F_{14}$ and $TiO_2$ of coatings, elemental analysis (EDX) was used. The EDX results are shown in Table 1. The coatings, independent of the NaCl concentration, all contain ~25 atomic percent oxygen. Assuming that this oxygen is contained in the initially amorphous $TiO_2$ phase, as seen after steam-induced partial crystallization to Brookite, the overall elemental composition is approximately accounted for by a coating composed of 45±15% amorphous $TiO_2$ and 55±15% crystalline $Na_5Ti_3F_{14}$.

TABLE 1

| | 0.3M NaCl | 1M NaCl | 2M NaCl |
|---|---|---|---|
| O | 25 | 26 | 24 |
| F | 40 | 40 | 40 |
| Ti | 16 | 16 | 16 |
| Al | 1 | 0.1 | 0.2 |
| Na | 18 | 18 | 19 |

Overall, methods of the present disclosure provide titanium oxide coatings having a sodium content. It has been discovered that including a sodium salt in the composition can provide a sodium content to the titanium-based coating (e.g. can provide $Na_5Ti_3F_{14}$, such as crystalline $Na_5Ti_3F_{14}$). Without being bound by theory, it is believed that the halide content of the salt additive can etch a native surface oxide on the substrate which provides deposition of a more adherent coating, as compared to conventional titanium-based coatings. In addition, halides are typically regarded as promoting corrosion of metal substrates, such as aluminum substrates. However, it has been discovered that titanium-based coatings of the present disclosure formed from halide-containing salts, and the coatings including sodium content (e.g. $Na_5Ti_3F_{14}$, such as crystalline $Na_5Ti_3F_{14}$), can provide improved corrosion resistance as compared to a titanium-based coating without a sodium content.

Although generally discussed in the context of aviation use, other possible uses of methods of the present disclosure are contemplated, such as on wind turbine blades, in non-aerospace transportation, and in communications, including satellite dishes.

The descriptions of the various aspects of the present disclosure have been presented for purposes of illustration, but are not intended to be exhaustive or limited to the aspects disclosed. Many modifications and variations will be apparent to those of ordinary skill in the art without departing from the scope and spirit of the described aspects. The terminology used herein was chosen to best explain the principles of the aspects, the practical application or technical improvement over technologies found in the marketplace, or to enable others of ordinary skill in the art to understand the aspects disclosed herein. While the foregoing is directed to aspects of the present disclosure, other and further aspects of the present disclosure may be devised without departing from the basic scope thereof.

What is claimed is:

1. A method of making a titanium-based coating, the method comprising:

contacting a substrate with an aqueous solution, wherein:

the substrate is selected from the group consisting of aluminum, aluminum alloy, nickel, iron, iron alloy, steel, titanium, titanium alloy, copper, copper alloy, or a mixture thereof;

the substrate is heated at a temperature of about 40° C. to about 80° C., and the aqueous solution comprises:

about 0.15 M to about 0.8 M of a titanium fluoride or a titanium fluorine complex, about 0.3 M to about 2 M of a halogenated sodium salt, and about 0.1 M to about 1.5 M of a fluorine scavenger, wherein the molar concentration of the halogenated sodium salt is greater than the molar concentration of the fluorine scavenger.

2. The method of claim 1, wherein the aqueous solution comprises:

about 0.15 M to about 0.25 M of the titanium fluoride or a titanium fluoride complex;

about 0.9 M to about 1.4 M of the halogenated sodium salt; and about 0.3 M to about 1 M of the fluorine scavenger.

3. The method of claim 2, wherein the halogenated sodium salt is sodium chloride.

4. The method of claim 3, wherein the titanium fluoride is $(NH_4)_2TiF_6$.

5. The method of claim 4, wherein the fluorine scavenger is boric acid.

6. The method of claim 1, wherein the substrate comprises aluminum.

7. The method of claim 6, wherein the substrate is a component of an aircraft.

8. The method of claim 1, wherein contacting comprises immersing the substrate in the aqueous solution.

9. The method of claim 1, wherein the titanium-based coating comprises titanium dioxide and $Na_5Ti_3F_{14}$.

10. The method of claim 9, wherein the titanium-based coating has a titanium dioxide content of about 30 wt % to about 70 wt %, based on the total weight of the coating.

11. The method of claim 9, wherein the titanium-based coating has a $Na_5Ti_3F_{14}$ content of about 30 wt % to about 70 wt %, based on the total weight of the coating.

12. The method of claim 11, wherein the titanium-based coating has a $Na_5Ti_3F_{14}$ content of about 40 wt % to about 55 wt %, based on the total weight of the coating.

13. The method of claim 9, wherein the titanium-based coating comprises an amorphous metal oxide phase and a crystalline sodium-containing phase.

14. The method of claim 13, wherein the amorphous metal oxide phase is titanium dioxide.

15. The method of claim 13, wherein the crystalline sodium-containing phase is $Na_5Ti_3F_{14}$.

16. The method of claim 9, wherein the titanium-based coating comprises about 40 wt % to about 50 wt % amorphous titanium dioxide and about 50 wt % to about 60 wt % crystalline $Na_5Ti_3F_{14}$, based on the total weight of the coating.

17. The method of claim 9, wherein the titanium-based coating has a thickness of about 20 mil to about 40 mil.

18. The method of claim 1, wherein the fluorine scavenger is boric acid having a concentration of about 0.3 M to about 1 M.

19. The method of claim 1, wherein the titanium-based coating comprises a fluorine content of about 1 atomic percent (at. %) to about 80 at. %, an oxygen content of about 1 at. % to about 80 at. %, a titanium content of about 1 at. % about 60 at. %, and a sodium content of about 1 at. % to about 60 at. %.

20. The method of claim 1, wherein the aqueous solution comprises the halogenated sodium salt in an amount of about 1M to about 1.3M.

* * * * *